United States Patent [19]

Lund, III

[11] 4,397,052

[45] Aug. 9, 1983

[54] PRENATAL SUPPORT PILLOW

[76] Inventor: Richard G. Lund, III, 7564 Major Ave. North, Brooklyn Park, Minn. 55443

[21] Appl. No.: 216,769

[22] Filed: Dec. 15, 1980

[51] Int. Cl.[3] ..... A47G 9/00

[52] U.S. Cl. ..... 5/431; 5/437; 5/462

[58] Field of Search ..... 5/462, 465, 437, 431, 5/436, 448, 435, 424, 425, 411

[56] References Cited

U.S. PATENT DOCUMENTS

| | | | |
|---|---|---|---|
| D. 222,349 | 10/1971 | Sorensen | D15/8 |
| D. 236,062 | 7/1975 | Winston | D6/201 |
| D. 241,700 | 10/1976 | Wattie | D6/201 |
| D. 242,388 | 11/1976 | Castelberry | D83/1 V |
| D. 248,141 | 6/1978 | Forsland | D6/201 |
| D. 250,985 | 2/1979 | Armstrong | D6/201 |
| D. 254,029 | 1/1980 | Barbagallo | D24/36 |
| D. 259,958 | 6/1981 | Fuller et al. | D6/201 |
| 2,314,080 | 7/1940 | Dine et al. . | |
| 2,562,725 | 7/1951 | Leto et al. . | |
| 3,118,152 | 1/1964 | Talley, Jr. . | |
| 3,287,747 | 11/1966 | Ellsworth . | |
| 3,333,286 | 8/1967 | Biolik . | |
| 3,639,927 | 2/1972 | Munch . | |
| 3,762,404 | 10/1973 | Sakita | 128/78 |
| 4,193,150 | 3/1980 | Vineberg . | |
| 4,214,326 | 7/1980 | Spann . | |
| 4,288,879 | 9/1981 | Pate | 5/431 |

OTHER PUBLICATIONS

Libin & Associates Brochure—"Wedge Turns Any Chair into a Massage Chair & Pillow Attachment".

*Primary Examiner*—Alexander Grosz

*Attorney, Agent, or Firm*—Burd, Bartz & Gutenkauf

[57] ABSTRACT

A support or pillow for supporting the abdomen of a pregnant primate female in a normal central position when the female is lying on her side. The pillow is a one-piece foam plastic body having a front containing a concave pocket. The pocket is of a size to accommodate the side of an abdomen of a female when lying on either her right or left side. In one form of the abdomen support, a back rest is attached to a pillow section to retain the abdomen in the pocket. Releasable fasteners connect the back rest to the pillow section.

22 Claims, 16 Drawing Figures

FIG. 1
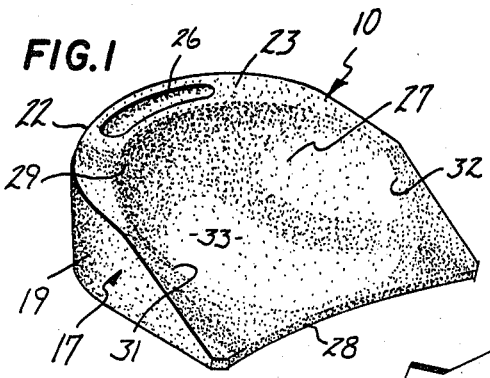
FIG. 2
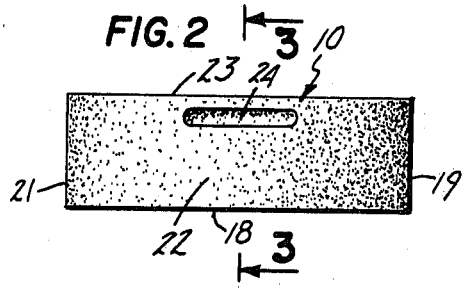
FIG. 7
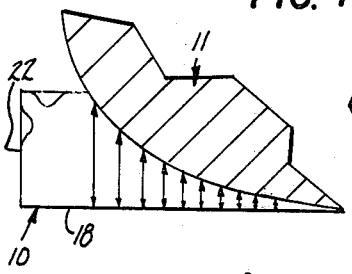
FIG. 4
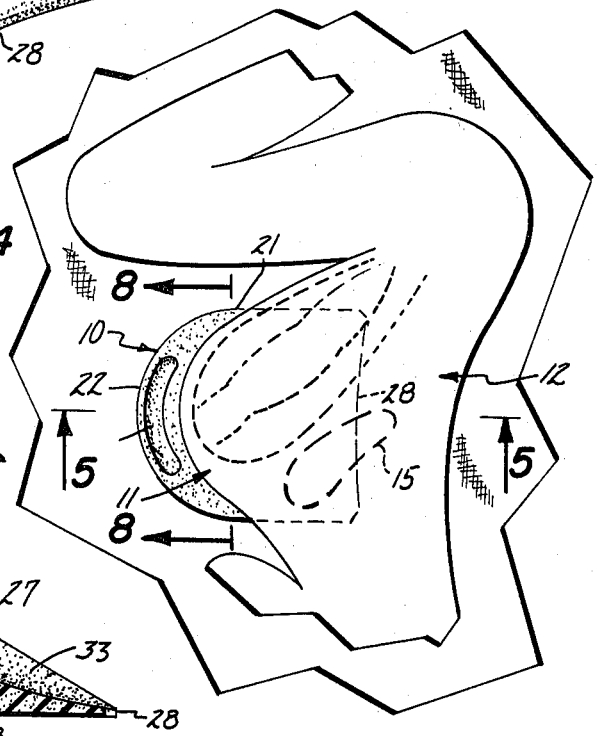
FIG. 3
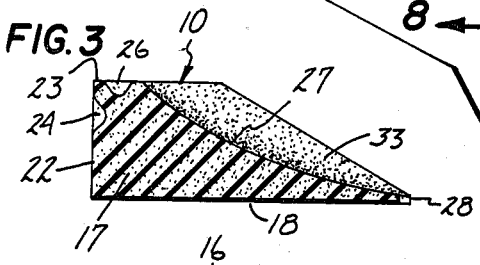
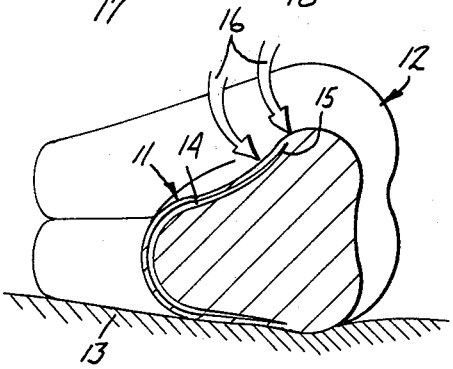
FIG. 6
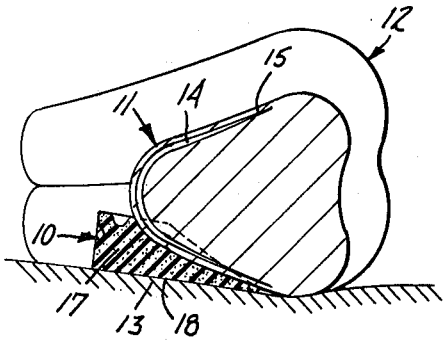
FIG. 5

PRENATAL SUPPORT PILLOW

SUMMARY OF INVENTION

The invention is related to a support device or pillow for supporting the abdomen of a pregnant primate female when she is lying in a side prone position. In the fifth month of pregnancy, some women experience a pulling sensation near the rib cage when lying in a side prone position in a bed or on a similar support surface. The pulling sensation is a discomfort that is attributed to stress on abdominal muscles due to an enlarged abdomen and the weight of the abdomen. The discomfort usually interferes with the sleep of the female. The expectant female may try several positions in an effort to alleviate the discomfort. Lying on the back is often uncomfortable, as it causes the weight of the abdomen to put pressure on the inferior vena cava thereby restricting the circulation of blood to the lower portions of the body. Resting on the enlarged abdomen is impractical, as well as uncomfortable.

Bed pillows have been used as props to afford some relief. The conventional bed pillow is not suitable as an abdomen prop, as it does not have a fixed shape and may actually push into the abdomen, rather than support it. The abdominal support of the invention has a body of compressible resilient material. The forward side of the body has a concave curved pocket of a size to accommodate the lower portion of the abdomen of a pregnant primate female lying in either the left or right side sleeping or prone position. The resilient body biases the abdomen upwardly in transverse and longitudinal directions to hold the abdomen in its normal generally central position so that muscle tension and stretching on both sides of the abdomen are substantially equal. The support relieves abnormal stretching of the abdominal muscles on one side of the abdomen and provides for a minimum of discomfort when lying in the side prone position.

The abdominal support is a one-piece foam plastic body that is sturdy in construction and durable in use. In the preferred abdominal support, the one-piece foam plastic body is made of a durable washable non-allergenic polyurethane, which has a soft and resilient pillow surface. The concave pocket is of a shape to cradle the enlarged abdomen over a substantial area of the lower side of the abdomen. This allows the pregnant female to have a support for her abdomen without inhibiting the generally free movement of the fetus. The abdomen support does not have any abrupt edges, seams, buttons, or hooks that would irritate the skin or injure the body of the female.

IN THE DRAWINGS

FIG. 1 is a perspective view of an abdominal support according to the invention;

FIG. 2 is a rear elevational view of FIG. 1;

FIG. 3 is a sectional view taken along the line 3—3 of FIG. 2;

FIG. 4 is a fragmentary view of a prone pregnant primate female with her abdomen resting on an abdominal support of the invention;

FIG. 5 is a reduced scale sectional view taken along the line 5—5 of FIG. 4;

FIG. 6 is a view similar to FIG. 5 without the abdominal support;

FIG. 7 is a sectional view taken along the line 5—5 of FIG. 4, showing transverse compression forces of the support;

DESCRIPTION OF PREFERRED EMBODIMENTS

Figure 8:
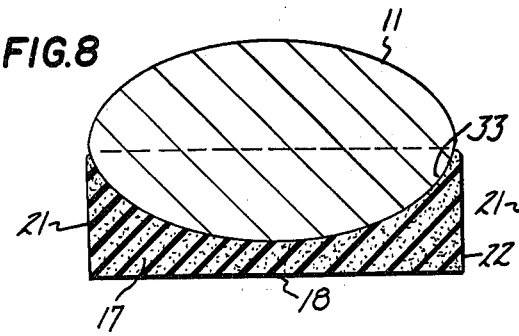
FIG. 8 is an enlarged sectional view taken along the line 8—8 of FIG. 4.

Referring to FIGS. 1 and 2, there is shown an abdominal support or pillow 10 of the invention for supporting an abdomen of a pregnant primate female, such as a human. Support 10 is used as an abdomen rest or prop to minimize the stretching of the abdomen wall muscles when the female is in a side prone position. The support 10 can be used by the female when she is either left or right side sleeping positions to prop her abdomen. As shown in FIG. 3, abdominal support 10 supports a female abdomen 11 of a pregnant primate human female 12 lying on her side on a mattress 13. Abdomen 11 has abdominal wall muscles 14 that extend around the abdomen and are attached near or to the opposite sides of the rib cage. During the latter term of pregnancy, the abdominal wall muscles are stretched and support the growing fetus. When the abdomen is shifted from its normal central position, one side of the abdominal wall muscles are stretched, while the other side of the abdominal wall muscles are relaxed. This causes muscle pulling near the rib cage. The muscle stretch or pull can be painful and interfere with sleep and comfort of the female.

As shown in FIG. 6, when female 12 is in the side prone position on mattress 13 the abdomen 11 moves downwardly in engagement with mattress 13 stretching the upper side abdominal wall muscles 14 in the areas 15 where the muscles are connected to the rib cage, as indicated by arrow 16. This results in a muscle stress area which is a cause of pain and discomfort. Pillow support 10 functions to retain abdomen 11 in a central position above mattress 13 to reduce the stress on abdomen wall muscles 14. Maintaining the abdomen in its normal generally central location relative to the body of the female causes the abdominal wall muscles to naturally function with substantially equal pulling or contraction forces on opposite sides of the rib cage when female 12 is in a side prone sleeping position. Support 10 holds the abdomen 11 in its natural centralized position. This reduces the force or weight of the uterus on the vena cava and thereby allows for more effective cardiac efficiency. The uterus normally rests on the vena cava, restricting the cardiac efficiency. This can cause drowsiness, dizziness, and general discomfort. These symptoms can be alleviated by reducing the weight of the uterus on the vena cava.

Returning to FIGS. 1–3, pillow 10 is a one-piece body of flexible elastic material, such as foamed plastic, having the characteristics of elastic memory. The material is biologically compatible with the skin tissue, nonallergenic, and does not absorb nor retain moisture. An example of foam plastic material for body 17 is polyurethane 3J9-J199. Other types of resilient materials can be used for the body.

Body 17 has a flat bottom 18 and generally upright parallel sides 19 and 21. The sides 19 and 21 are joined to an outwardly curved outside end 22. The outer end of the body 17 has a generally flat top surface 23. End 22 has a central horizontal recess 24 that is located adjacent a transverse horizontal recess 26 in top 23. Recesses 24 and 26 are elongated grooves for the thumb and fingers of the hand to facilitate the movement and manipulation of pillow 10 by female 12 under her abdomen.

Pillow 10 has an upwardly and rearwardly inclined front 27 having a generally semi-hemispherical pocket or recess that accommodates a substantial portion of the lower side of abdomen 11. The size and shape of the pocket is compatible with the general size and shape of an abdomen of a pregnant primate female in the last term of pregnancy. The forward and lower part of the pocket is located adjacent a lip 28 adjacent the front of bottom 18. The rear of the pocket has an outwardly curved top edge 29. Edge 29 is joined to downwardly and forwardly directed sides 31 and 32 that extend toward lip 28. The pocket has a continuous surface 33 that is concave curved in the transverse direction, as shown in FIG. 3, and the longitudinal direction, as shown in FIG. 8 with respect to transverse and longitudinal orientations of abdomen 11. The radius of the concave curved surface of the pocket is in the range of 30 to 60 cm. The pocket surface is inclined upwardly and outwardly away from the inner edge 28 of the body.

One specific abdomen support is a one-piece generally square polyurethane body having a length of 30.5 cm, a width of 30.5 cm, and a thickness of 10 cm. The pocket has a curvature radius of 41 cm. The mid-section of the concave section of the body forming the pocket is inclined upwardly and outwardly at an angle of 30 degrees from the flat bottom of the body.

Another abdomen support is a one-piece generally square polyurethane body having a pocket. The pocket has a curvature radius of 51 cm. The mid-section of the concave section of the body forming the pocket is inclined upwardly and outwardly at an angle of 25 degrees from the flat bottom of the body. Other materials for the body and dimensions of the body and size of the pocket can be used.

Body 17, being made of compressible resilient material, functions as a spring or cushion that exerts an upwardly directed biasing force on the abdomen. The biasing force progressively increases from body lip 28 to the outer end 22 of the body. As shown in FIG. 7, vertical arrows indicate the increase in the biasing force of yielding material of body 17. The biasing force is a function of the thickness of the material. As the material thickness increases in the transverse direction, the amount of force increases so that increasing forces from lip 28 to edge 29 will hold the abdomen 11 in its generally normal centralized position, as shown in FIG. 4, relative to the longitudinal direction of the body of the female.

Figure 9:
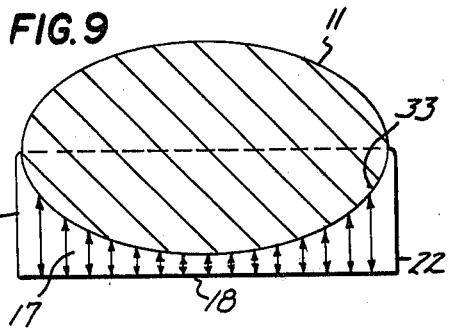
FIG. 9 is a longitudinal compression force diagram along section line 8—8 of FIG. 4.

The abdomen lifting forces progressively increase from lip 28 to edge 29. When the lower side of abdomen 11 is positioned in surface engagement with body surface 33, there is no concentration or void in the upward biasing force on the abdomen so that a large surface of abdomen 11 is subjected to the biasing force. Referring to FIG. 8, abdomen 11 longitudinally fits into the pocket and longitudinally engages surface 33. FIG. 9 shows the vertical compression force diagram of body 17 on a longitudinal segment of the abdomen 11. The upward biasing forces on abdomen 11 progressively increase in opposite longitudinal directions from a transverse plane through the center portion of the body. This supports abdomen 11 in the longitudinal direction or direction generally parallel to the spinal column of the female 12 and maintains the normal longitudinal position of the abdomen.

Figure 12:
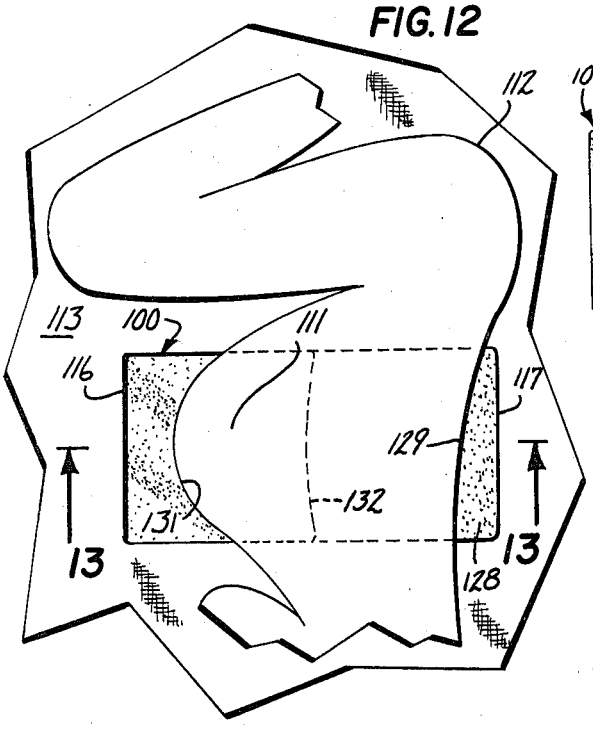
FIG. 12 is a fragmentary view of a prone pregnant primate female resting on the abdominal support of FIG. 10.
Figure 10:
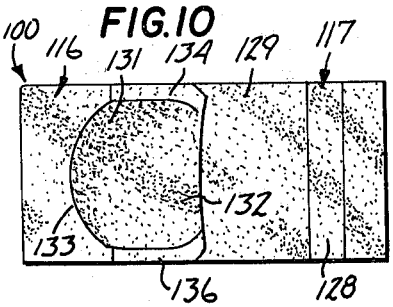
FIG. 10 is a top plan view of a first modification of the abdominal support.
Figure 11:
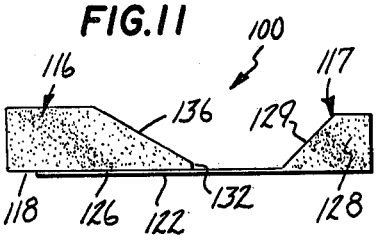
FIG. 11 is a side view of FIG. 10.
Figure 13:
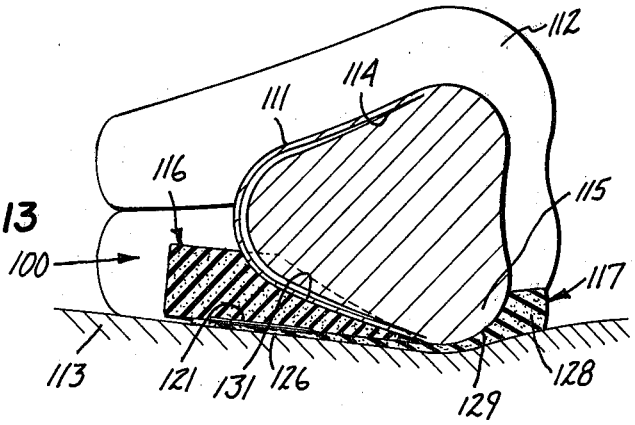
FIG. 13 is a sectional view taken along the line 13—13 of FIG. 12.

Referring to FIGS. 10–12, there is shown a first modification of the abdomen support or pillow indicated generally at 100 for supporting abdomen 111 of a pregnant primate female 112, such as a human. Female 112 is lying in a prone side sleeping position on mattress 113 with abdomen 111 resting on pillow 100. As shown in FIG. 13, abdominal wall muscles 114 are not subjected to unequal pulling force, as abdomen 111 is elevated to its natural position by pillow 100. Pillow or support 100 also supports or props up the lower back 115 of female 112, as hereinafter described.

Support 100 has a front or first member 116 releasably secured to a rear or second member 117. The members 116 and 117 are made of elastic material, such as the foam plastic material used to make body 17.

Figure 14:
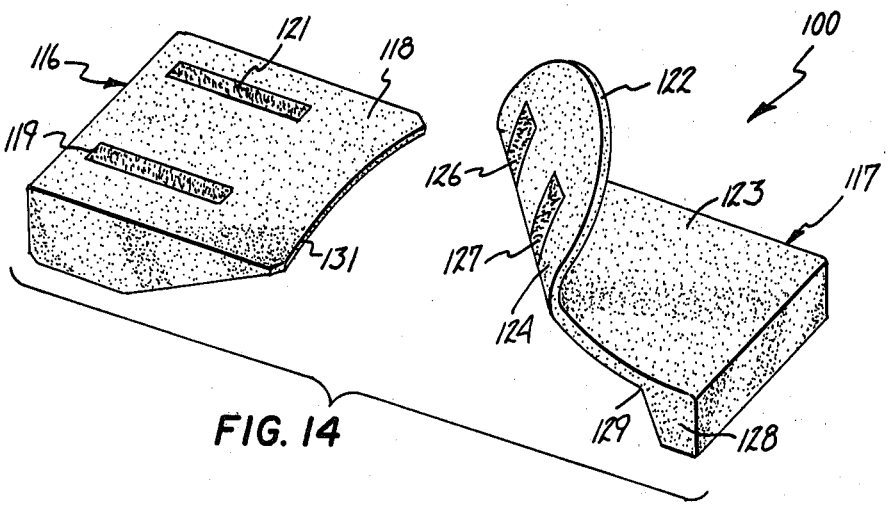
FIG. 14 is an exploded perspective view of the abdominal support of FIG. 10, as seen from the bottom thereof.

As shown in FIG. 14, first member 116 has a generally flat bottom 118. A pair of linear straps or strips of loops 119 and 121 are secured to bottom 118.

Second member 117 has a base or flat flap 122. Flap 122 has a flat bottom 123 and generally flat top 124. A pair of strips of hook elements 126 and 127 are secured to top 124. Hook elements 126 and 127 are laterally spaced from each other and are aligned with strip of loops 119 and 121 to form therewith releasable fasteners. The strips and loops can be releasable fasteners, sold under the trademark VELCRO, which permit the first and second members 116 and 117 to be releasably joined to each other in selected positions. The releasable fasteners allow each member 116 and 117 to be used separately.

Second member 117 has a longitudinal back rest or rib 128. The forward side of rest 128 has a downwardly and forwardly inclined inside wall 129 adapted to engage the lower back 115 of female 112. The first member 116 has a concave curved pocket 131 adapted to accommodate the lower portion of abdomen 111, as shown in FIG. 13. Pocket 131 has the same general shape as the pocket in the front 27 of pillow 10. Pocket 131 lies between the forward lip 132 and an outwardly curved rear edge 133. The sides 134 and 136 of the body are generally linear and extend in a fowardly and downward direction.

In use, as shown in FIG. 13, abdomen 111 fits into pocket 131 and is transversely and longitudinally supported and upwardly biased to elevate abdomen 111 to its normal central location thereby equalizing the stretching forces on abdominal wall muscles 114. Back rest 128 engages the lower back 115 and retains and holds member 116 so as to prevent the accidental slipping of the first member 116 away from abdomen 111. The releasable fasteners that couple first member 116 and second member 117 permit the adjustment of the back rest to accommodate the enlargement of abdomen 111 during all stages and particularly the latter stages of pregnancy.

Figure 15:
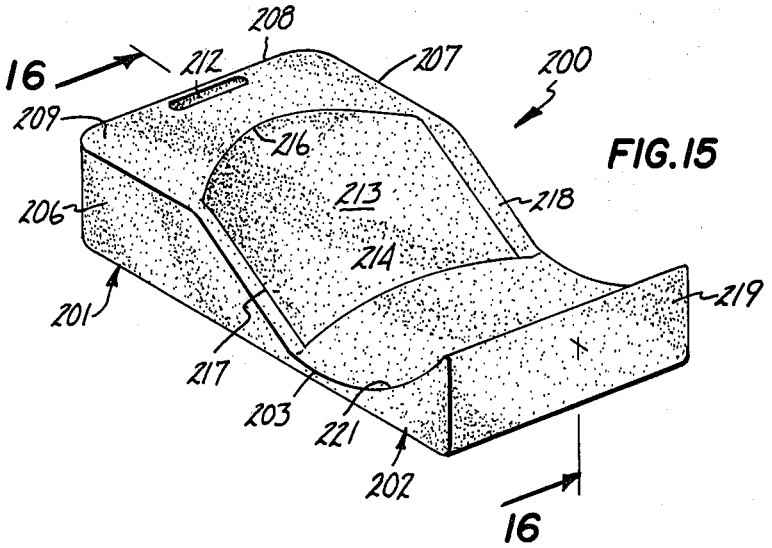
FIG. 15 is a perspective view of a second modification of the abdominal support.
Figure 16:
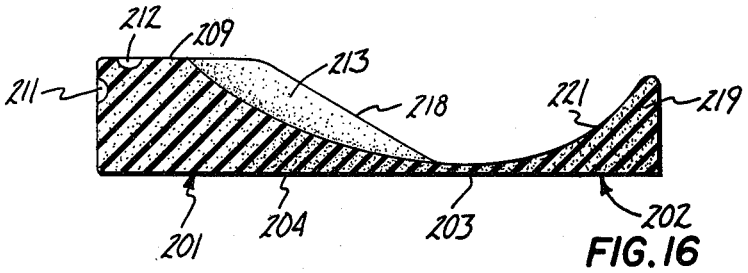
FIG. 16 is a sectional view taken along the line 16—16 of FIG. 15.

Referring to FIGS. 15 and 16, there is shown a second modification of abdominal support or pillow indicated generally at 200. Support 200 has a first body 201 laterally spaced from a second body 202. A web 203 joins first body 201 to second body 202. The first body 201, second body 202, and web 203 are a one-piece elastic member, such as the material of body 17 of support 10. Support 200 has a generally flat bottom wall 204 adapted to engage a mattress or similar supporting surface. The bottom 204 is continuous and forms part of the first body 201, second body 202, and web 203.

The first body 201 has generally upright sides 206 and 207 joined to a curved outside end 208. Body 201 has a generally flat top 209 formed with a horizontal transverse central groove 212. End 208 has an upper transverse horizontal groove 211 which forms with groove 212 a hand grip to facilitate the movement of support 200. Body 201 has an abdomen receiving pocket 213 having a transverse and longitudinal concave curved shape. The lower part of pocket 213 has a bottom edge 214. The pocket 213 extends upwardly to an outwardly located top edge 216. The opposite sides of pocket 213 are located adjacent forwardly and downwardly inclined side edges 217 and 218. Pocket 213 has a transverse and longitudinal concave curvature that provides for progressively increasing upward biasing forces from the lower central area of pocket 213 so as to provide a compression force that holds the abdomen in a generally central position, while the female is lying in either a right or left side prone position.

Support 200 has a longitudinal back rest or rib 219 having an inside concave wall 221 adapted to engage the lower back of the female. Back rest 219 functions as a barrier or a stop which minimizes the inadvertent movement of the first body 209 from under the abdomen of a prone female.

While there has been shown and described the preferred embodiments of the abdominal support of the invention, it is understood that changes in the shape, size, materials, and structure can be made by those skilled in the art without departing from the invention. The invention is defined in the following claims.

The embodiments of the invention in which an exclusive property or privilege is claimed are defined as follows:

1. A support for the abdomen of a person resting in a side position comprising: body means of compressible elastic material for supporting the abdomen of a person lying in a side position on supporting means, said body means having first means adapted to engage the supporting means, and second means including an upwardly and outwardly directed concave curved pocket, said pocket being of a size to accommodate a lower portion of the abdomen when the person is resting in a side position whereby said body means of compressible elastic material yieldably supports the abdomen in its normal generally central position relative to the body of the person, back engaging means spaced from the body means for holding the body means in engagement with the abdomen, and means connecting the back engaging means to the body means said means connecting the back engaging means to the body means including releasable fastener means holding the back engaging means and body means in selected positions relative to each other thereby allowing the locations of the back engaging means and body means to be changed to accommodate varying abdomen sizes.

2. The support of claim 1 wherein: the body means is a one-piece foam plastic material.

3. The support of claim 1 wherein: the first means is a generally flat bottom surface of the body means.

4. The support of claim 1 wherein: the body means has a convex curved rear portion.

5. The support of claim 4 wherein: said rear portion has at least one groove to facilitate hand gripping of the body means.

6. The support of claim 1 wherein: the body means has a bottom surface, and a narrow forward edge located adjacent the bottom surface of the body means adapted to be positioned under the abdomen, said pocket extended upwardly and rearwardly from said forward edge.

7. The support of claim 6 wherein: the forward edge extends in a general longitudinal direction relative to longitudinal direction of the person using the support.

8. The support of claim 1 wherein: the pocket is inclined in an upward and rearward direction and the upward biasing action of the body means on the abdomen increases from a forward edge toward a rear portion of the body means.

9. The support of claim 8 wherein: the upward biasing action of the body means on the abdomen increases in opposite longitudinal directions from a plane transversely transversing the longitudinal mid-section of the body means.

10. The support of claim 1 wherein: the first means includes a generally flat bottom surface of the body means, said body means having a narrow forward edge located adjacent the bottom surface, said edge extended in the general longitudinal direction of the abdomen and adapted to be positioned under the abdomen, said pocket extended upwardly and rearwardly from said forward edge whereby the upward biasing action of the body means increases from the forward edge toward a rear portion of the body means and increases in opposite longitudinal directions from the mid-section of the pocket.

11. The support of claim 10 wherein: the body means has a front concave surface forming said pocket, said surface having a curvature radius in the range of 30 to 60 cm and said surface having a mid-section inclined upwardly and outwardly at an angle of between 20 to 40 degrees relative to the bottom surface of the body means.

12. The support of claim 10 wherein: said body means is a one-piece foam plastic member.

13. The support of claim 10 wherein: the body means has a convex curved rear portion.

14. The support of claim 13 wherein: said rear portion has at least one groove to facilitate hand gripping of the body means.

15. The support of claim 1 wherein: said releasable fastener means includes cooperating hook means and loop means on said back engaging means and body means.

16. The support of claim 1 wherein: said means connecting the back engaging means to the body means includes a generally flat web joined to the back engaging means, and said releasable fastener means connecting said web to the body means, said releasable fastener means allowing the location of the back engaging means and body means to be changed relative to each other to accommodate varying abdomen sizes.

17. The support of claim 16 wherein: said releasable fastener means comprise cooperating hook means and loop means on the web and body means.

18. A support for the abdomen of a person resting in a side position comprising: a first member having a body of compressible elastic material, said body having an upwardly and outwardly directed concave curved pocket of a size to accommodate a lower portion of the abdomen when the person is resting in a side position whereby the body of compressible resilient material yieldably supports the abdomen, a second member engageable with the back of the person, and means connecting the first member with the second member so that the second member when located in engagement with the back of the person holds the first member in engagement with the abdomen of the person, said abdomen being located in said pocket of the body said means connecting the first member with the second member including releasable fastener means holding the first and second members in selected positions relative to each other thereby allowing the locations of the first and second members to be changed relative to each other accommodate varying abdomen sizes.

19. The support of claim 18 wherein: said second member has a concave curved inside surface adapted to engage the back of the person.

20. The support of claim 18 wherein: said releasable fastener means comprise hook means on one member and loop means on the other member.

21. The support of claim 18 wherein: said means connecting the first member and second member includes a generally flat web joined to one member and releasable fastener means connecting said web to the other member, said releasable fastener means allowing the location of the first and second members to be changed relative to each other to accommodate varying abdomen sizes.

22. The support of claim 21 wherein: said releasable fastener means comprise cooperating hook means and loop means on the web and other member.

* * * * *

UNITED STATES PATENT AND TRADEMARK OFFICE

CERTIFICATE OF CORRECTION

PATENT NO. : 4,397,052

DATED : August 9, 1983

INVENTOR(S) : Richard G. Lund III

It is certified that error appears in the above-identified patent and that said Letters Patent is hereby corrected as shown below:

Column 2, line 32, after "is" insert -- in --.

Signed and Sealed this

*Twentieth* Day of *March 1984*

[SEAL]

*Attest:*

GERALD J. MOSSINGHOFF

*Attesting Officer*

*Commissioner of Patents and Trademarks*